United States Patent [19]

Anderson

[11] Patent Number: 5,006,763

[45] Date of Patent: Apr. 9, 1991

[54] LUMINAIRE FOR AN ELECTRODELESS HIGH INTENSITY DISCHARGE LAMP WITH ELECTROMAGNETIC INTERFERENCE SHIELDING

[75] Inventor: John M. Anderson, Scotia, N.Y.

[73] Assignee: General Electric Company, Schenectady, N.Y.

[21] Appl. No.: 491,920

[22] Filed: Mar. 12, 1990

[51] Int. Cl.[5] ..... H05B 41/24

[52] U.S. Cl. ..... 315/248; 315/85

[58] Field of Search ..... 315/85, 248; 313/153, 313/160, 161

[56] References Cited

U.S. PATENT DOCUMENTS

| | | | |
|---|---|---|---|
| 3,763,392 | 10/1973 | Hollister | 315/248 |
| 3,860,854 | 1/1975 | Hollister | 315/248 |
| 4,152,745 | 5/1979 | Eul | 315/8 X |
| 4,187,445 | 2/1980 | Houston | 315/54 |
| 4,187,447 | 2/1989 | Stout et al. | 315/85 |
| 4,409,521 | 10/1983 | Roberts | 315/57 |
| 4,810,938 | 3/1989 | Johnson et al. | 315/248 |
| 4,812,702 | 3/1989 | Anderson | 313/153 |
| 4,910,439 | 3/1990 | El-Hamamsy et al. | 315/248 |
| 4,959,584 | 9/1990 | Anderson | 313/493 |

*Primary Examiner*—David Mis

*Attorney, Agent, or Firm*—Jill M. Breedlove; James C. Davis, Jr.; Marvin Snyder

[57] ABSTRACT

A luminaire for an electrodeless high intensity discharge (HID) lamp includes passive and/or active electromagnetic interference (EMI) shielding apparatus. One embodiment of passive EMI shielding apparatus comprises at least one section of a conductive conical surface oriented so that its longitudinal axis is coincident with the envelope of the HID lamp. Currents are induced in the outer surface of the conductive cone-section, establishing a radio frequency magnetic field tending to eliminate the radio frequency magnetic field induced by current through the excitation coil of the lamp. Alternative or additional types of passive EMI shielding apparatus include a conductive disk having an opening for surrounding the envelope in the vicinity of the arc tube, and nested conductive cylinders. Active EMI shielding apparatus comprises a loop of wire for carrying a current in order to establish another magnetic field tending to reduce or eliminate EMI. A luminaire for directing light radiated by the HID lamp includes a parabolic reflector which functions as passive EMI shielding apparatus and, in one embodiment, comprises a waveguide beyond cutoff for preventing electromagnetic radiation from propagating through the lamp.

23 Claims, 4 Drawing Sheets

LUMINAIRE FOR AN ELECTRODELESS HIGH INTENSITY DISCHARGE LAMP WITH ELECTROMAGNETIC INTERFERENCE SHIELDING

RELATED PATENT APPLICATION

This application is related to commonly assigned, copending U.S. Pat. application of J.M. Anderson, Ser. No. 370,664 now U.S. Pat. No. 4,959,584, filed June 23, 1989, which patent application is hereby incorporated by reference.

FIELD OF THE INVENTION

The present invention relates generally to electrodeless high intensity discharge (HID) lamps. More particularly, the present invention relates to a luminaire for an electrodeless HID lamp employing passive and active electromagnetic interference shielding apparatus.

BACKGROUND OF THE INVENTION

In a high intensity discharge (HID) lamp, a medium to high pressure ionizable gas, such as mercury or sodium vapor, emits visible radiation upon excitation typically caused by passage of radio frequency (RF) current through the gas. One class of HID lamps comprises electrodeless lamps which generate an arc discharge by generating a solenoidal electric field in a high-pressure gaseous lamp fill. In particular, the lamp fill, or discharge plasma, is excited by RF current in an excitation coil surrounding an arc tube. The arc tube and excitation coil assembly acts essentially as a transformer which couples RF energy to the plasma. That is, the excitation coil acts as a primary coil, and the plasma functions as a single-turn secondary. RF current in the excitation coil produces a varying magnetic field, in turn creating an electric field in the plasma which closes completely upon itself, i.e., a solenoidal electric field. Current flows as a result of this electric field, resulting in a toroidal arc discharge in the arc tube.

Although electrodeless HID lamps generally provide good color rendition and high efficacy in accordance with the standards of general purpose illumination, if unshielded, such lamps typically produce electromagnetic interference (EMI) which adversely affects, for example, radio and television reception. Therefore, it is desirable to provide electrodeless HID lamps exhibiting reduced EMI without appreciable reduction in visible light output, thus making such lamps practicable for widespread general illumination applications.

OBJECTS OF THE INVENTION

Accordingly, it is an object of the present invention to provide a luminaire for an electrodeless HID lamp including passive and/or active electromagnetic interference shielding means.

Another object of the present invention is to provide electromagnetic interference shielding means for an electrodeless HID lamp which does not interfere appreciably with visible light output.

Still another object of the present invention is to provide a luminaire for directing light output from an electrodeless HID lamp including passive and/or active electromagnetic interference shielding means.

Yet another object of the present invention is to provide a luminaire for directing light output from an electrodeless HID lamp which includes passive EMI shielding means comprising a waveguide beyond cutoff.

SUMMARY OF THE INVENTION

The foregoing and other objects of the present invention are achieved in a new and improved luminaire for an electrodeless HID lamp which comprises passive and/or active EMI shielding means. The luminaire of the present invention comprises an elongated, light-transmissive envelope enclosing an arc tube containing an ionizable, gaseous fill. An excitation coil is situated about the envelope for establishing a first radio frequency magnetic field extending through the arc tube, thereby exciting an arc discharge therein. The excitation coil is arranged about the arc tube in such manner as to permit only minimal light blockage. A first preferred embodiment of the new luminaire includes passive EMI shielding means comprising at least one conductive section of a cone (hereinafter designated cone-section) disposed proximate the envelope and oriented so that its longitudinal axis is parallel to, or coincident with, the longitudinal axis of the envelope. Current is induced in the conductive cone-section by the first radio frequency magnetic field which, in turn, induces another radio frequency magnetic field. The radio frequency magnetic field induced by current in the conductive cone-section tends to cancel, at a distance, the first radio frequency magnetic field, thereby acting as a passive EMI shield. A conductive cone-section of the present invention further preferably comprises light reflecting means for minimizing light losses at the ends of the envelope so as to maximize light output from the lamp. To this end, the cone-section is comprised of, for example, a highly polished metal, such as aluminum or silver.

An alternative embodiment of a passive EMI shielding means useful in the luminaire of the present invention comprises a conductive disk thin enough to interfere only minimally with emitted light, employed alone or in combination with the hereinabove described conductive cone-section. Such a disk has an opening therein for surrounding the lamp envelope in the vicinity of the arc tube. The plane of the disk is oriented substantially perpendicular to the longitudinal axis of the envelope so that circulating currents induced thereon establish another magnetic field tending to cancel, at a distance from the lamp, the first magnetic field.

Another alternative embodiment of passive EMI shielding means useful in the luminaire of the present invention comprises at least one conductive cylinder oriented so that its longitudinal axis is parallel to, or coincident with, the longitudinal axis of the envelope. By so orienting the conductive cylinder, circulating currents are induced on the surface of the cylinder by the first radio frequency magnetic field which produce another magnetic field tending to cancel, at a distance from the lamp, the first magnetic field.

In another aspect of the present invention, active EMI shielding means are provided for an electrodeless HID luminaire. A preferred embodiment of the active EMI shielding means comprises a conductive loop arranged so that the plane of the loop is substantially perpendicular to the longitudinal axis of the envelope. A radio frequency power source supplies current to the conductive loop which results in the establishment of another radio frequency magnetic field that tends to cancel, at a distance from the lamp, the first radio frequency magnetic field.

In still another aspect of the present invention, a luminaire is provided for directing light radiated from an HID lamp. Such a luminaire employs a parabolic reflector of suitable curvature for the formation of a directed optical beam. Advantageously, the parabolic reflector functions as a passive EMI shielding means. The degree of EMI shielding provided by the parabolic reflector depends on the curvature thereof. In one embodiment, the parabolic reflector comprises a conducting sleeve for containing the HID lamp. The conducting sleeve comprises a "waveguide beyond cutoff". That is, the cutoff wavelength of the waveguide is less than the wavelength of the first radio frequency magnetic field. In particular, the largest dimension of the waveguide is sufficiently small to prevent the first magnetic field from propagating therethrough. Hence, the magnetic field cannot be supported as a traveling wave and becomes attenuated as an evanescent wave.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
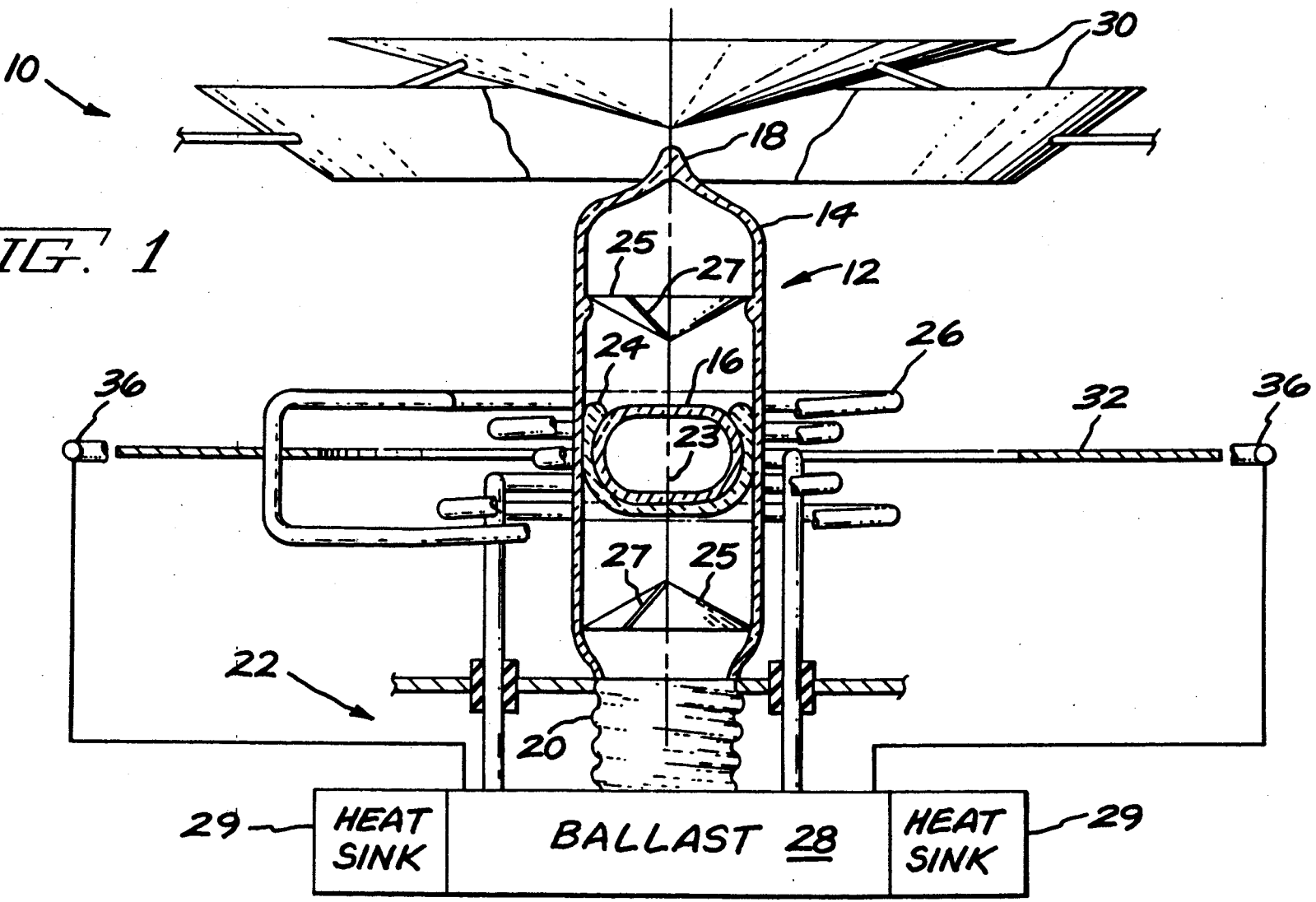
FIG. 1 is a cross sectional side view of a luminaire for housing an HID lamp in accordance with a preferred embodiment of the present invention.

FIG. 1 illustrates a luminaire 10 for housing an HID lamp 12 in accordance with a preferred embodiment of the present invention. HID lamp 12 has an elongated, outer envelope 14 enclosing an arc tube 16. Envelope 14 and arc tube 16 each comprise a light-transmissive material, such as fused quartz or polycrystalline alumina. Envelope 14 includes a typical exhaust tip 18 for evacuation and backfill of gas in the space between arc tube 16 and envelope 14, and a base 20 for insertion into a corresponding type socket (not shown) of a base assembly 22 of luminaire 10. By way of example, an Edison screw base-and-socket configuration may be used, as illustrated in FIG. 1. However, any suitable base-and-socket configuration may be employed, such as a plug type or bayonet type, the same being well known in the art.

Arc tube 16 is shown as having a short, substantially cylindrical structure with rounded edges. Such a structure advantageously promotes isothermal lamp operation, thus decreasing thermal losses and hence increasing efficiency. However, other arc tube structures, e.g. spherical, may be suitable depending upon the particular application of the lamp. Arc tube 16 is illustrated as being surrounded by an insulating layer or thermal jacket 24 to limit cooling thereof. A suitable insulating layer is made of a high temperature refractory material, such as quartz wool, as described in commonly assigned U.S. Pat. No. 4,810,938, issued on Mar. 7, 1989 to P.D. Johnson, J.T. Dakin and J.M. Anderson, which patent is hereby incorporated by reference. Quartz wool is comprised of thin fibers of quartz which are nearly transparent to visible light, but which diffusely reflect infrared radiation.

Arc tube 16 contains a fill in which an arc discharge is excited during lamp operation. A suitable fill, described in U.S. Pat. No. 4,810,938, hereinabove cited, comprises a sodium halide, a cerium halide and xenon combined in weight proportions to generate visible radiation exhibiting high efficacy and good color rendering capability at white color temperatures. For example, such a fill may comprise sodium iodide and cerium chloride, in equal weight proportions, in combination with xenon at a partial pressure of about 500 torr. Another suitable fill is described in copending U.S. Pat. application Ser. No. 348,433 now U.S. Pat. No. 4,972,120 of H.L. Witting, filed on May 8, 1989 and assigned to the instant assignee. The fill of that patent application comprises a combination of a lanthanum halide, a sodium halide, a cerium halide and xenon or krypton as a buffer gas. More specifically, such a fill may comprise, for example, a combination of lanthanum iodide, sodium iodide, cerium iodide, and 250 torr partial pressure of xenon.

An excitation coil 26 surrounds arc tube 16 for exciting an arc discharge in the fill. By way of example, coil 26 is illustrated as having six turns which are arranged to have a substantially V-shaped cross section on each side of a coil center line 23. Such a coil configuration is described in commonly assigned U.S. Pat. No. 4,812,702 of J.M. Anderson, issued Mar. 14, 1989, which patent is hereby incorporated by reference. Other suitable coil configurations may be employed, such as that described in commonly assigned, copending U.S. Pat. application of H.L. Witting, Ser No. 240,331 now U.S. Pat. No. 4,894,591, filed Sep. 6, 1988, which is hereby incorporated by reference. The latter Witting application describes an inverted excitation coil comprising first and second solenoidally-wound coil portions, each being disposed upon the surface of an imaginary cone having its vertex situated within the arc tube or within the volume of the other coil portion.

Light reflectors 25, preferably cone-shaped as illustrated, are situated at either end of lamp envelope 14 for reflecting light emitted by the arc discharge out through the lamp envelope. Such light reflectors each comprise a slit 27 for preventing a short circuit in the primary winding of the lamp transformer assembly described hereinabove, thus preventing the establishment of strong circulating currents on the surfaces of light reflectors 25 which would induce a magnetic field and cause additional EMI.

Excitation coil 26 is coupled to a lamp ballast 28 which supplies radio frequency energy to the HID lamp and comprises part of the base assembly 22 of luminaire 10. Heat radiating fins 29 are shown attached to the housing of ballast 28. A suitable ballast 28 is described in commonly assigned, copending U.S. Pat. application of J.C. Borowiec and S.A. El-Hamamsy, Ser. No. 472,144 filed Jan. 30, 1990, which patent application is hereby incorporated by reference. The lamp ballast of the cited patent application is a high-efficiency ballast comprising a Class-D power amplifier including a tuned network. The tuned network includes an integrated tuning capacitor network and heat sink. In particular, a series/-blocking capacitor and a parallel tuning capacitor are integrated by sharing a common capacitor plate; and, the metal plates of the parallel tuning capacitor comprise heat sink planes of a heat sink used to remove excess heat from the excitation coil of the lamp. Alternatively, as described in commonly assigned, copending U.S. Pat. application Ser. No. 134,498 of S.A. El-Hamamsy and J.M. Anderson, filed Dec. 17, 1987, now U.S. Pat. No. 4,910,439, and hereby incorporated by reference, a suitable electrodeless HID lamp ballast includes a network of capacitors that is used both for impedance matching and heat sinking. In particular, a pair of parallel-connected capacitors has large plates that are used to dissipate heat generated by the excitation coil and arc tube.

In operation, ballast 28 supplies radio frequency current to excitation coil 26 which thereby induces a first time-varying radio frequency magnetic dipole field extending through arc tube 16 and radiating outwardly therefrom. The varying magnetic field in turn produces a solenoidal electric field which is sufficiently strong to cause a counter current to flow through the ionizable fill, thus producing a toroidal arc discharge in the arc tube. Furthermore, the counter current producing the arc discharge also produces a time-varying magnetic dipole field, but this field is of insufficient strength to cancel the magnetic field induced by the coil current. As a result, there is undesirable radiation of electromagnetic energy, which is a potential source of EMI.

In accordance with a preferred embodiment of the present invention, luminaire 10 comprises passive EMI shielding means including at least one conductive cone-section 30 disposed outside envelope 14 and oriented so that the first radio frequency magnetic dipole field induces currents in the conductive cone-section. In particular, the longitudinal axis of such a cone-section 30 is parallel to that of envelope 14 or coincident therewith. By way of example, the luminaire of FIG. 1 is illustrated as having two conductive cone-sections 30. The currents in cone-sections 30 induce a radio frequency magnetic field which tends to cancel, at a distance from the lamp, the first radio frequency magnetic field, thereby reducing or eliminating EMI from the HID lamp. Furthermore, the conductive cone-sections 30 of the present invention comprise light reflecting means for minimizing light losses at the ends of the envelope, thereby maximizing light output from the lamp. To this end, cone-sections 30 are comprised of, for example, a highly polished metal, such as aluminum or silver.

The passive EMI shielding means of the present invention comprises a thin conductive disk 32 which may be used in lieu of cone-section(s) 30 or in conjunction therewith. Disk 32 has an opening therein for surrounding lamp envelope 14 in the vicinity of arc tube 16. The plane of such a disk 32 is oriented perpendicularly to envelope 14 so that currents are induced therein by the first radio frequency magnetic field. These induced currents establish another radio frequency magnetic field which tends to cancel, at a distance from the lamp, the first radio frequency magnetic field, thereby reducing or eliminating EMI from the HID lamp.

Still another embodiment of passive EMI shielding means of the present invention comprises at least one conductive cylinder which may be used in conjunction with, or in lieu of, either or both conductive cone-sections 30 and conductive disk 32. By way of example, as illustrated in FIG. 3, three nested conductive cylinders 34 are disposed above lamp envelope 14. Similarly to cone-sections 30, the longitudinal axes of conductive cylinders 34 are parallel to, or coincident with, the longitudinal axis 23 of envelope 14, the surfaces of cylinders 34 being almost parallel to light rays emitted from arc tube 16 so as to minimize light obstruction. Currents are induced in conductive cylinders 34, resulting in another magnetic field tending to cancel, at a distance from the lamp, the first radio frequency magnetic field.

A preferred embodiment of luminaire 10 of the present invention further comprises active EMI shielding means. As illustrated in FIG. 1, a preferred active EMI shielding means comprises a loop of current-carrying wire 36. Wire 36 is coupled to ballast 28 which supplies radio frequency current thereto. The radio frequency current in wire 36 induces a sufficiently strong magnetic dipole field tending to cancel, at a distance from the lamp, the first radio frequency magnetic field. It is to be understood that although a combination of passive and active EMI shielding means are illustrated in FIG. 1, it may be desirable to use either type of EMI shielding means, rather than both, depending upon the particular application.

Figure 2:
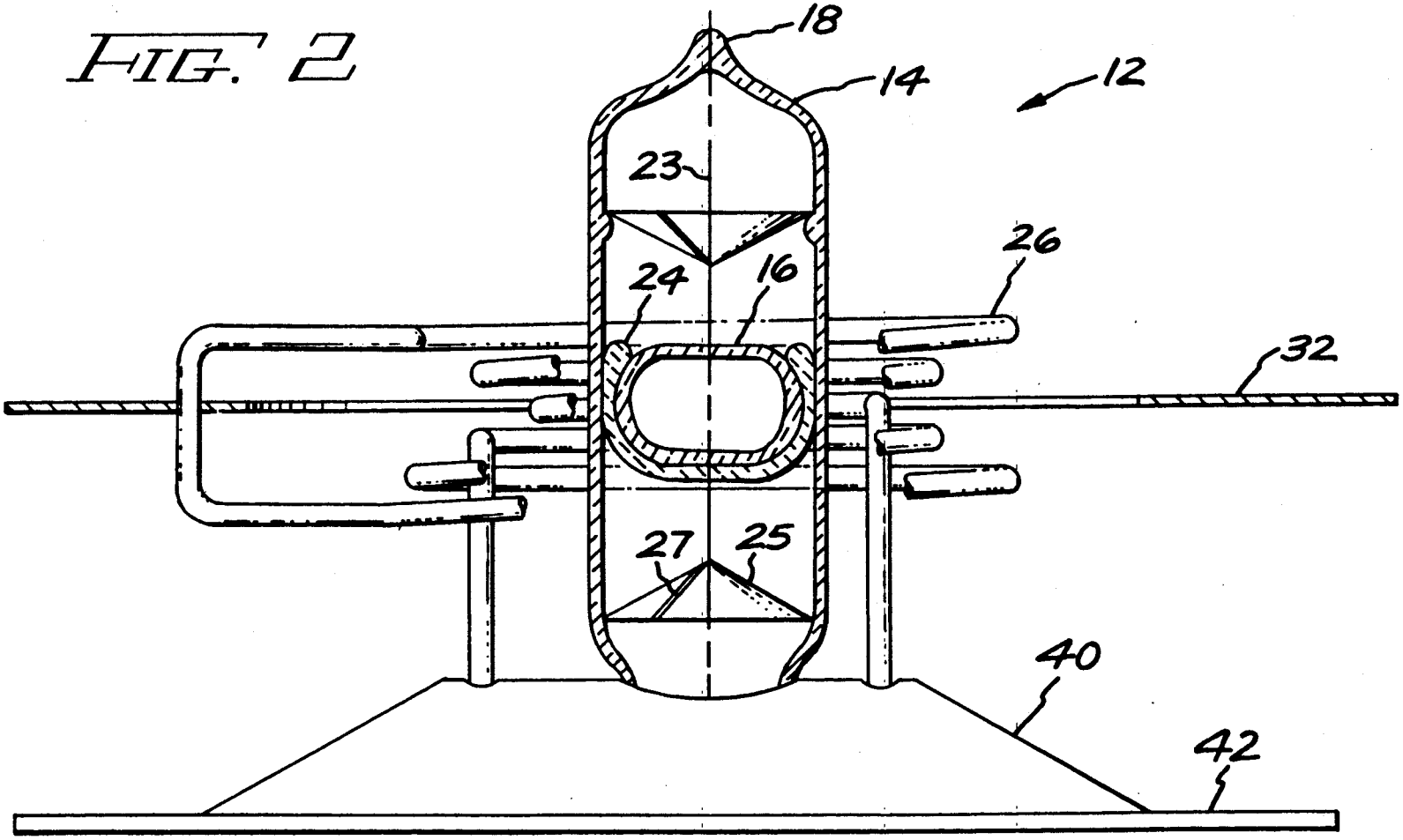
FIG. 2 is a side view of a luminaire according to a preferred embodiment of the present invention, such as that of FIG. 1, including a preferred housing structure for the lamp ballast.

FIG. 2 illustrates a housing 40 for enclosing base assembly 22 (FIG. 1) of luminaire 10. Housing 40 is mounted on a light-reflective base plate 42. Housing 40 also preferably comprises light-deflecting means for deflecting light output from HID lamp 12. To this end, housing 40 is preferably wedge-shaped and comprises a light-reflective material, such as a highly polished metal, e.g. aluminum.

Figures 3A, 3B:
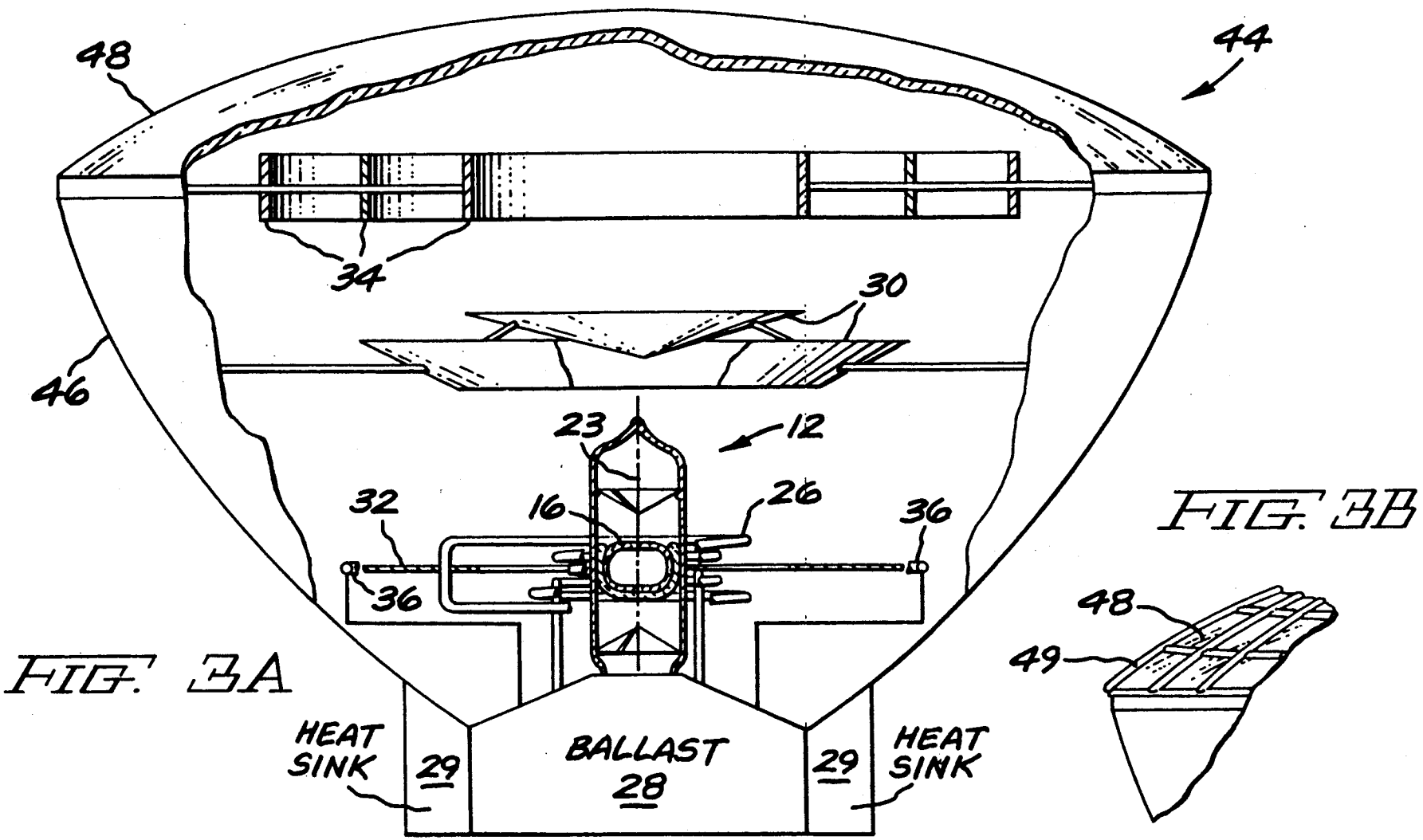
FIG. 3A is a partially cutaway side view of a luminaire for directing light output from an HID lamp according to a preferred embodiment of the present invention.
FIG. 3B is partial side view of the luminaire of FIG. 3A including a metallic mesh cover.

In another aspect of the present invention, FIG. 3 illustrates a luminaire 44 for directing light rays in a desired emission pattern from an HID lamp in accordance with a preferred embodiment of the present invention. Luminaire 44 comprises a parabolic reflector 46 of suitable curvature for the formation of a directed light beam, with a protective cover 48 of a suitable light-transmissive material, such as a glass or plastic. Luminaire 44 is illustrated as comprising passive EMI shield means including conductive cone-sections 30, conductive disk 32, and nested conductive cylinders 34. Moreover, as illustrated in FIG. 3B, luminaire 44 may be provided with a metallic mesh cover 49 in conformance with protective cover 48 to provide further EMI suppression, if desired. In addition, as illustrated in FIG. 3A, luminaire 44 may include active EMI shielding means comprising current-carrying wire 36 coupled to ballast 28.

Figure 4:
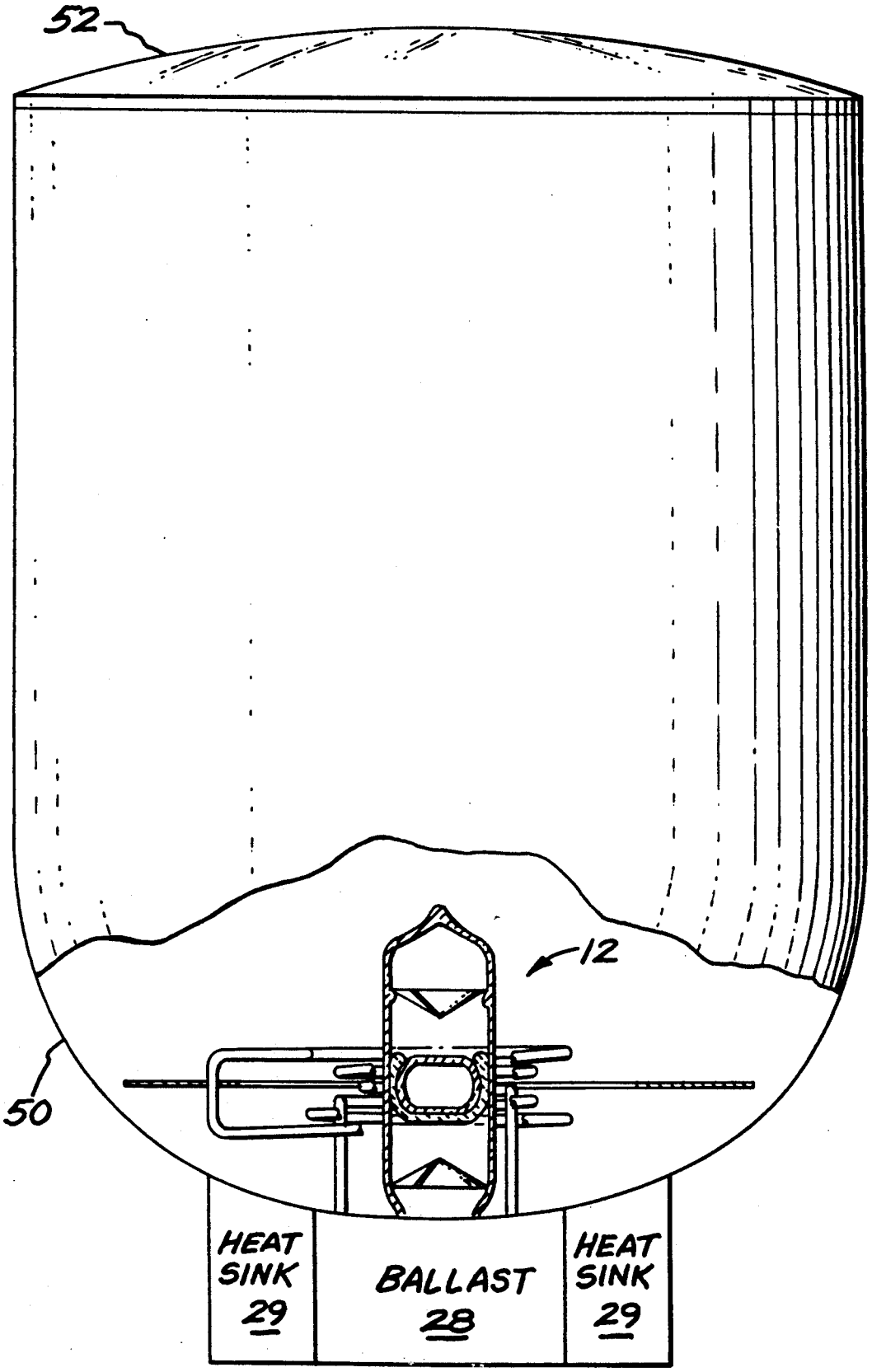
FIG. 4 is a partially cutaway side view of an alternative embodiment of a luminaire for directing light output from an HID lamp, including a waveguide beyond cutoff for attenuating electromagnetic radiation from the HID lamp, in accordance with a preferred embodiment of the present invention.

As described hereinabove, either or both active and passive EMI shielding means may be employed, depending upon the particular application. Advantageously, parabolic reflector 46 itself functions as a passive EMI shielding means. The degree of EMI shielding provided by the parabolic reflector depends on the curvature thereof. In one embodiment, as illustrated in FIG. 4, a parabolic reflector 50 comprises a conducting sleeve for containing the HID lamp. A protective cover 52 comprises a suitable light-transmissive material, such as glass or plastic. The conducting sleeve comprises a "waveguide beyond cutoff". That is, the cutoff wavelength of waveguide 50 is less than the wavelength of the radio frequency magnetic field induced by the excitation coil current. In particular, the largest dimension of waveguide 50 is sufficiently small to prevent the magnetic field from propagating therethrough. Hence, the magnetic field cannot be supported as a traveling wave and attenuates as an evanescent wave. The EMI wave in the conducting sleeve can be attenuated further by coating the inside surface thereof with a resistive layer to partially absorb surface currents.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A luminaire, comprising:

an electrodeless high intensity discharge lamp including an elongated, light-transmissive envelope and a light-transmissive arc tube disposed within said envelope for containing a fill;

an excitation coil coupled to a radio frequency power supply and disposed about said envelope for establishing a first radio frequency magnetic field extending through said arc tube and radiating outwardly therefrom, said first radio frequency magnetic field exciting an arc discharge in said fill so as to produce visible light output which passes through said arc tube and said light-transmissive envelope;

a base assembly for mounting said lamp thereon; and passive electromagnetic shielding means comprising at least one conductive surface situated proximate said envelope and oriented such that said first radio frequency magnetic field induces current on said surface that establishes a second radio frequency magnetic field tending to cancel, at a distance from said lamp, said first radio frequency magnetic field, said passive electromagnetic shielding means interfering minimally with said visible light output.

2. The luminaire of claim 1 wherein said conductive surface comprises the outer surface of at least one cone-section, the longitudinal axis of said cone-section being substantially parallel to the longitudinal axis of said envelope.

3. The luminaire of claim 1 wherein said conductive surface comprises the surface of a conductive disk having an opening therein for surrounding said envelope in the vicinity of said arc tube, said disk being substantially perpendicular to the longitudinal axis of said envelope.

4. The luminaire of claim 1 wherein said conductive surface comprises the outer surface of at least one cylinder situated proximate said envelope, the longitudinal axis of said cylinder being substantially parallel to the longitudinal axis of said envelope.

5. The luminaire of claim 1 further comprising active electromagnetic interference-shielding means including a conductive loop disposed about said envelope and coupled to said radio frequency power supply for supplying radio frequency current thereto, said loop being oriented such that the current in said loop establishes an additional radio frequency magnetic field tending to cancel, at a distance from said lamp, said first radio frequency magnetic field.

6. The luminaire of claim 1 further comprising conductive light reflecting means disposed proximate said envelope for reflecting light radiated from said arc tube through said envelope.

7. The luminaire of claim 6 wherein said conductive light reflecting means comprises a light reflecting cone disposed within said envelope at each end thereof and along the longitudinal axis of said envelope.

8. The luminaire of claim 2 wherein said cone-section further comprises conductive light reflecting means for reflecting light radiated from said arc tube through said envelope.

9. The luminaire of claim 8 wherein the outer surface of said cone-section is comprised of aluminum.

10. The luminaire of claim 1 wherein said base assembly comprises a substantially wedge-shaped housing for enclosing said radio frequency power supply, said housing comprising a light-reflective material.

11. The luminaire of claim 10 wherein said light-reflective material comprises aluminum.

12. A luminaire for producing a directed optical beam of light, comprising:

an electrodeless high intensity discharge lamp including an elongated, light-transmissive envelope and a light-transmissive arc tube disposed within said envelope for containing a fill;

an excitation coil coupled to a radio frequency power supply and disposed about said envelope for establishing a first radio frequency magnetic field extending through said arc tube and radiating outwardly therefrom, said first radio frequency magnetic field exciting an arc discharge in said fill;

a base assembly for mounting said lamp thereon;

passive electromagnetic shielding means comprising at least one conductive surface situated proximate said envelope and oriented such that said first radio frequency magnetic field induces current on said surface that establishes a second radio frequency magnetic field tending to cancel, at a distance from said lamp, said first radio frequency magnetic field; and light directing means comprising a parabolic reflector for receiving light radiated from said arc tube and for forming said directed optical beam of light therefrom.

13. The luminaire of claim 12 wherein said passive electromagnetic shielding means comprises the inner surface of said parabolic reflector.

14. The luminaire of claim 12 wherein said passive electromagnetic shielding means comprises the outer surface of at least one cone-section, the longitudinal axis of said cone-section being substantially parallel to said envelope.

15. The luminaire of claim 14 wherein said cone-section further comprises light reflecting means for reflecting light radiated from said arc tube through said envelope.

16. The luminaire of claim 15 wherein the outer surface of said cone-section is comprised of aluminum.

17. The luminaire of claim 12 wherein said passive electromagnetic shielding means comprise-s the surface of a conductive disk having an opening therein for surrounding said envelope in the vicinity of said arc tube, said disk being substantially perpendicular to the longitudinal axis of said envelope.

18. The luminaire of claim 12 wherein said passive electromagnetic shielding means comprises the outer surface of at least one cylinder situated proximate said envelope, the longitudinal axis of said cylinder being substantially parallel to the longitudinal axis of said envelope.

19. The luminaire of claim 12 further comprising active electromagnetic interference shielding means including a conductive loop disposed about said envelope and coupled to said radio frequency power supply for supplying radio frequency current thereto, said loop being oriented such that the current in said loop establishes an additional radio frequency magnetic field tending to cancel, at a distance from said lamp, said first radio frequency magnetic field.

20. The luminaire of claim 12 further comprising light reflecting means disposed proximate said envelope for reflecting light radiated from said arc tube through said envelope.

21. The luminaire of claim 20 wherein said light reflecting means comprises a light reflecting cone disposed within said envelope at each end thereof and along the longitudinal axis of said envelope.

22. The luminaire of claim 12 wherein said parabolic reflector further comprises a waveguide having a cutoff wavelength less than the wavelength of said first radio frequency magnetic field so that said first radio frequency magnetic field cannot propagate therethrough.

23. The luminaire of claim 12 wherein said light directing means further comprises a light-transmissive cover disposed over the open end of said parabolic reflector, said light-transmissive cover including a conductive mesh layer comprising additional passive electromagnetic shielding means.

* * * * *